US007394396B2

(12) United States Patent
Seki et al.

(10) Patent No.: US 7,394,396 B2
(45) Date of Patent: Jul. 1, 2008

(54) ELECTRICAL APPARATUS, IMAGE FORMING APPARATUS AND OPERATION PROGRAM PRODUCT

(76) Inventors: Koji Seki, c/o Kyocera Mita Corporation, 2-28, Tamatsukuri 1-chome, Chuo-ku, Osaka-shi, Osaka (JP) 540-8585; Masuo Kawamoto, c/o Kyocera Mita Corporation, 2-28, Tamatsukuri 1-chome, Chuo-ku, Osaka-shi, Osaka (JP) 540-8585; Yoshinobu Kawakami, c/o Kyocera Mita Corporation, 2-28, Tamatsukuri 1-chome, Chuo-ku, Osaka-shi, Osaka (JP) 540-8585; Hideki Takeda, c/o Kyocera Mita Corporation, 2-28, Tamatsukuri 1-chome, Chuo-ku, Osaka-shi, Osaka (JP) 540-8585

( * ) Notice: Subject to any disclaimer, the term of this patent is extended or adjusted under 35 U.S.C. 154(b) by 233 days.

(21) Appl. No.: 11/194,407

(22) Filed: Aug. 1, 2005

(65) Prior Publication Data

US 2006/0028432 A1 Feb. 9, 2006

(30) Foreign Application Priority Data

Aug. 9, 2004 (JP) ..... 2004-231946

(51) Int. Cl.
*G08B 3/00* (2006.01)

(52) U.S. Cl. ..... 340/691.1; 340/691.6; 340/815.53

(58) Field of Classification Search ..... 340/691.1, 340/691.4, 691.6, 815.52, 815.53, 815.78; 358/1.15, 1.9, 504, 518; 709/206, 232
See application file for complete search history.

(56) References Cited

U.S. PATENT DOCUMENTS

| | | | | |
|---|---|---|---|---|
| 6,831,755 | B1 * | 12/2004 | Narushima et al. | 358/1.9 |
| 6,931,432 | B1 * | 8/2005 | Yoshida | 709/206 |
| 7,027,172 | B1 * | 4/2006 | Parulski et al. | 358/1.15 |
| 7,159,190 | B2 * | 1/2007 | Perry | 715/825 |
| 7,242,312 | B2 | 7/2007 | Kamiya | |
| 2002/0005859 | A1 * | 1/2002 | Murata | 345/629 |

FOREIGN PATENT DOCUMENTS

| | | |
|---|---|---|
| JP | 5-6065 | 1/1993 |
| JP | 9-106224 | 4/1997 |
| WO | WO 03/100760 | 12/2003 |

* cited by examiner

*Primary Examiner*—Van T. Trieu
(74) *Attorney, Agent, or Firm*—Gerald E. Hespos; Anthony J. Casella

(57) ABSTRACT

An operation section (28) of an image forming apparatus main body (2) comprises an operation display panel (30) for displaying letters and/or symbols representing various functions with respect to an image forming operation to allow an operator to select a desired function, and a status display panel (40) for displaying an image representing a growth stage and/or an appearance of a living thing such as a fish to show a current status of the main body (2). Accordingly, the current status of main body (2) is visually displayed on a display panel by association with a growth stage and/or an appearance of an actual living thing or an imaginary living thing, thereby enabling the operator to quickly see the present status of the apparatus.

20 Claims, 9 Drawing Sheets

ELECTRICAL APPARATUS, IMAGE FORMING APPARATUS AND OPERATION PROGRAM PRODUCT

BACKGROUND OF THE INVENTION

1. Field of the Invention

The present invention relates to an electrical apparatus and an image forming apparatus, more particularly to an electrical apparatus such as a copier, a facsimile, a printer, adapted to display operation contents on a display panel screen, and an operation program product.

2. Description of the Related Art

In conventional image forming apparatuses such as copiers, a display panel of an operation section mainly serves as a display for copying condition settings necessary for the copying operation. The function of the display panel is the same both for the outside discharge-type image forming apparatuses and the inside discharge-type image forming apparatuses.

As shown in FIG. 10, an operation display panel 130 defined in an operation section 128 comprises a function selection key 131, a sheet feed cassette setting display key 132, an image reduction/enlargement ratio display key 133, an image density setting display key 134, a sorting mode setting display key 135, a numeric keypad (not shown) and a JAM display, etc.

When setting copying conditions in an image forming apparatus as described above, an operator must first set an image density, a number of copies to be made, a sheet supply cassette by using the display panel provided in the operation section, and after confirming the settings, he/she may initiate the copy operation by pushing the print button. If a sheet jams in a conveyor path, a jam message is displayed on the display panel to urge the operator to remove the jammed sheet.

Also, when a toner cartridge is almost empty, a toner-need-to-replenish message is displayed, and when the toner cartridge becomes empty, a toner empty message is displayed on the display panel to urge the operator to refill. Likewise, when the number of copied sheets by the image forming apparatus becomes equal to or higher than a set value, a message that the apparatus needs maintenance is displayed on the display panel (hereinafter referred to as the former prior art).

Another image forming apparatus is also known that upon occurrence of any inconveniences (failures), a jam remove sequence is displayed on an LCD display by way of machine images which combine a plurality of image parts. For instance, when a jam occurs at a location covered by a front cover member, on the display panel appear an image display division to display a three-dimensional image of an operating member at the location where the sheet is jammed (display of a three-dimensional image of the apparatus), an operation message display division to display a sequence of jam removal operations (e.g., open the front cover), a jam message display division to display an occurrence of a jamming (e.g., sheet is jammed), and an arrow image indicating the direction of opening the front cover in a downward direction (Japanese Unexamined Patent Publication Hei 5-6065).

The copying condition setting display of the former prior art is necessary for the copying operation. However, once the display contents is set, the set contents cannot be changed until the copy operation is completed or until the setting is reset in the maintenance/check operation. For instance, in the case that the toner-need-to-replenish message is displayed to urge a toner refill operation, the operator cannot concretely estimate what the quantity of the remaining toner is. With the image forming apparatus disclosed in the above-mentioned patent publication, people who have not used the copying machines before or who are reluctant to use machines (i.e., image forming apparatus) are confused by the complex operation and operation function display of the image forming apparatus.

On the one hand, in the case that the machine operates normally, the operator has nothing else to do other than waiting in front of the machine during the copy operation and this waiting time becomes extremely boring. Especially, in the case of making a large number of copies of documents, a very large amount of time is wasted.

SUMMARY OF THE INVENTION

It is an object of the present invention to provide an electrical apparatus, an image forming apparatus and an operation program product which enable an operator to quickly know a current status of the apparatus.

According to an aspect of the invention, an electrical apparatus comprises a status display panel provided at a viewable position of main body of the apparatus and adapted for displaying an image including a picture of a predetermined character associated with a current status of the main body.

The electrical apparatus preferably includes a display controller for controlling the display of the image on the status display panel, the display controller receiving information concerning a current status of the main body and causing the status display panel to display the image including a picture of a predetermined character associated with the received current status information.

In such a configuration, the character preferably includes an actual living thing or an imaginary living thing, and the image represents a growth stage and/or an appearance of the actual living thing or the imaginary living thing associated with the current status information of the main body.

According to another aspect of the invention, an image forming apparatus comprises an operation display panel provided in a an operation section of a main body of the image forming apparatus, and adapted for displaying letters, symbols or operation characters representing various functions with respect to an image forming operation to allow an operator to select a desired function, and a status display panel provided in the operation section or the operation display panel for displaying an image representing a growth stage and/or an appearance of an actual living thing or an imaginary living thing to show a current status of the main body.

In the electrical apparatus or image forming apparatus of the present invention, an image of a predetermined character associated with the current status is displayed on a status display panel to show the current status of a main body of the electrical apparatus or a main body of the image forming apparatus such that the operator can quickly know the current status of the electrical apparatus main body or the image forming apparatus main body.

Characters in the images to be displayed on the status display can include actual living things or imaginary living things, such that it is possible to indicate the current status of the main body by images of characters which are agreeable to the operator, thereby providing a higher degree of convenience.

DETAILED DESCRIPTION OF THE PREFERRED EMBODIMENTS

Next, embodiments of the present invention are described with reference to the accompanying drawings.

An electrical apparatus according to an embodiment of the present invention is provided with a status display panel at a visible position in the apparatus main body. The status display panel is capable of displaying image information. The electrical apparatuses include household electrical appliances such as audio-video apparatus, washing machines, rice cookers, energy-generating apparatuses such as boilers, co-generation equipment, and office apparatuses or image forming apparatuses such as copiers, printers, facsimile machines, or composite machines capable of implementing these functions. Also, the status display panel may be integrally mounted in the electrical apparatus main body or may also be incorporated in a remote controller carrying out a remote control operation. In the following, a description is given of the preferred embodiments of the invention using an image forming apparatus as an exemplary electrical apparatus.

Figure 1:
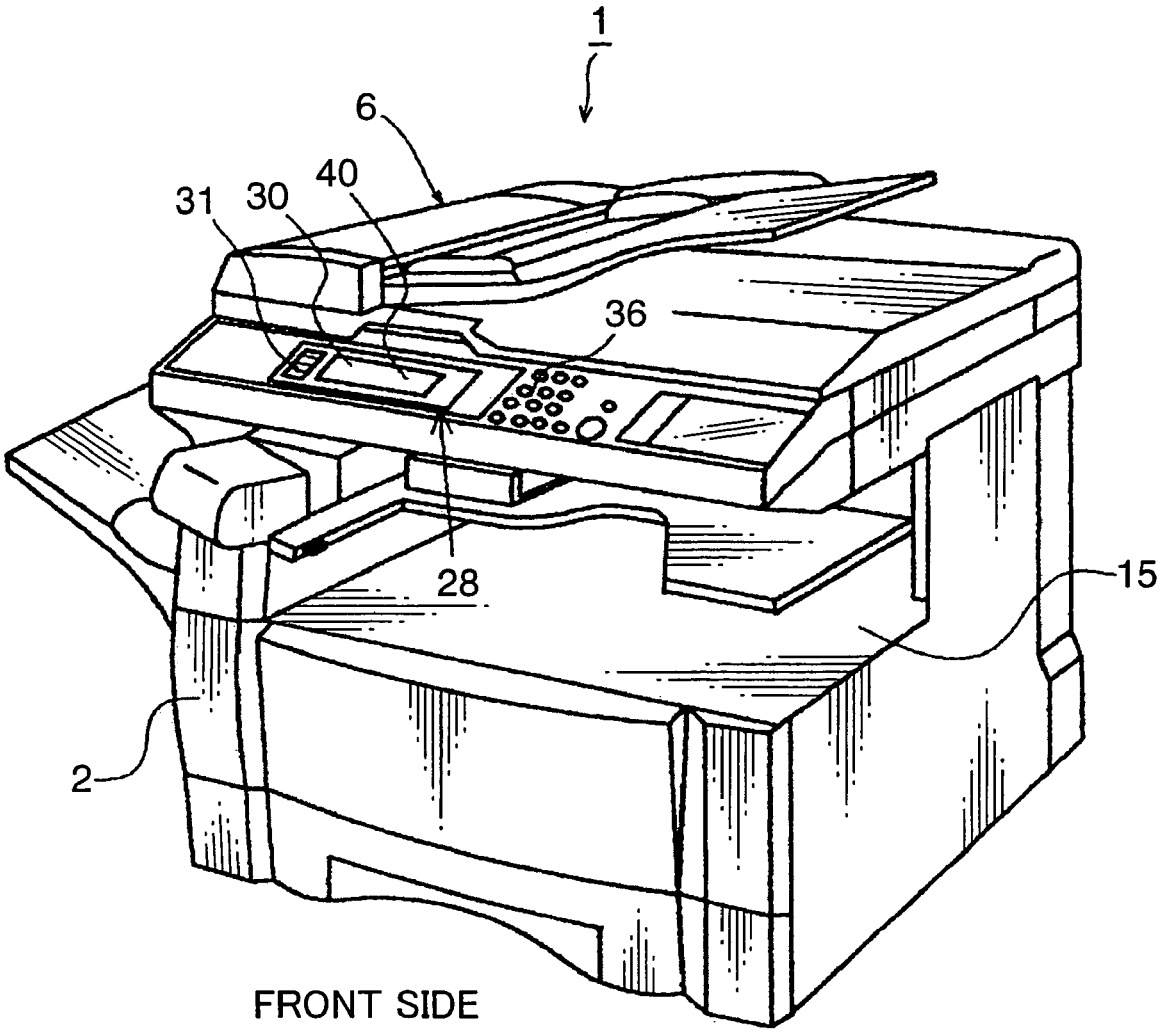
FIG. 1 is a perspective view showing an overall construction of an image forming apparatus according to a first embodiment of the invention.

FIG. 1 is a perspective view of an image forming apparatus according to an embodiment of the invention. In FIG. 1, an image forming apparatus 1 comprises a main body 2 provided with an operation section 28 on a front upper side thereof. The operation section 28, which is later described in detail, comprises a variety of keys such as a function select key 31 for selecting a desired one from copying function, printing function, scanning function, facsimile function, etc. and a numerical key 36, and an operation display panel 30 which has a liquid crystal display device. This operation display panel 30 is adapted to display a variety of types of information with respect to the image forming operation to the operator by using characters, symbols or operation characters (icons, etc.) and at the same time enables the operator to select desired one from the variety of types of displayed information.

Figure 2:
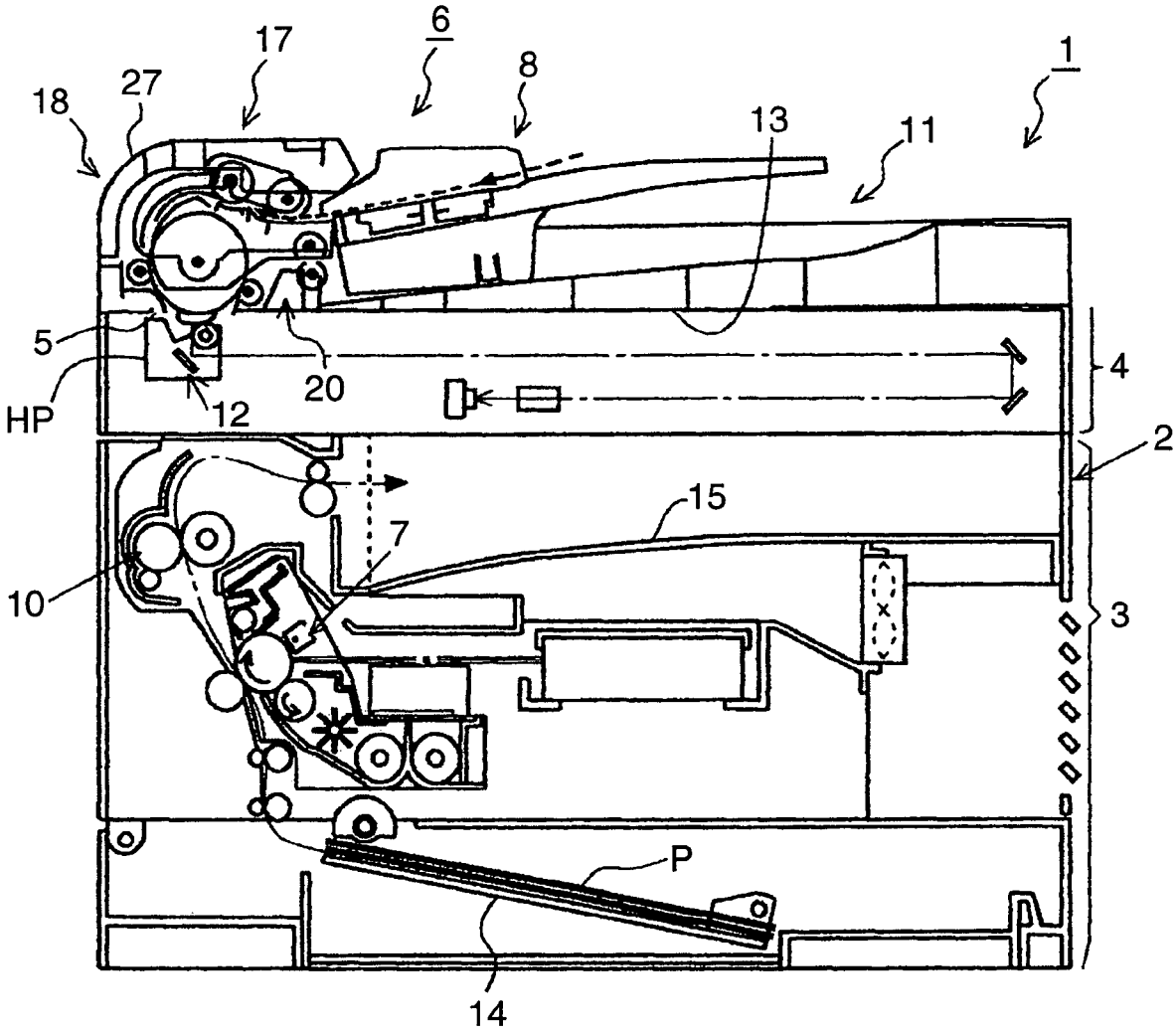
FIG. 2 is a side sectional view of the image forming apparatus shown in FIG. 1.

As shown in FIG. 2, the main body 2 of the image forming apparatus 1 houses a printing section 3 and a scanning section 4. In a rear portion of an upper side of the image forming apparatus main body 2, there is provided an original document automatic feeder device 6 that automatically feeds the sheets of the original documents one by one to a contact glass (image reading unit) 5.

The scanning section 4 of the image forming apparatus 1 reads an image on the original document fed to the contact glass (image reading unit) 5 by the original document automatic feeder device 6, and photoelectrically converts the optical image data to electric data and to digital data which is then outputted to an image forming portion 7 of the printing section 3.

The image forming portion 7 provided in the printing section 3 forms a toner image on a sheet P (recording medium such as sheet, plastic film, OHP sheet, etc.) fed from a sheet feed tray 14 and a fixing unit 10 fixes the toner image on the sheet P by application of heat and pressure, after which the printed sheet P is discharged onto a discharge tray 15.

A scanning unit 12 is stayed at an image reading position (HP) in the scanning section 4 to scan an original document fed by the original document automatic feeder device 6. Alternatively, the scanning unit 12 is moved from the image reading position (HP) in a right direction as illustrated in FIG. 2 in order to scan an image-of an original document fixedly placed on an upper surface of a platen glass (image reading unit) 13. Also, the image forming portion 7 is adapted to transfer a toner image to a sheet P according to image data read by the scanning section 4 and image data outputted from a copying machine, a facsimile machine, or a personal computer.

The original document automatic feeder device 6 is rotatably attached to an upper rear side (a rear side of FIG. 1) of the image forming apparatus main body 2. The original document feeder device 6 can be rotated in an upward direction so as to lift it from the image forming apparatus main body 2, thereby enabling an operator to open an upper surface of a platen glass 13 attached to an upper side of the image forming apparatus main body 2.

The original document automatic feeder device 6 is provided with a sheet feed tray 8, a sheet feed section 17 which is covered by a front cover 27 to feed an original document placed on the sheet feed tray 8 to an original document conveyor path (direction of the broken arrow), a conveyor section 18 for guiding the fed original document to the contact glass (image reading unit) 5, a sheet discharge tray 11 provided at a lower side of the sheet feed tray 8 and a sheet discharge section 20 for discharging the original document read by the image reading unit onto the sheet discharge tray 11.

The sheet feed section 17 sends the sheets of an original document placed on the sheet feed tray 8 one by one to the original document conveyor path and then the conveyor section 18 conveys the sheet to the contact glass (image reading unit) 5. The scanning unit 12 reads an image on the original document after which the sheet discharge section 20 discharges the original document onto the sheet discharge tray 11.

Figure 3:
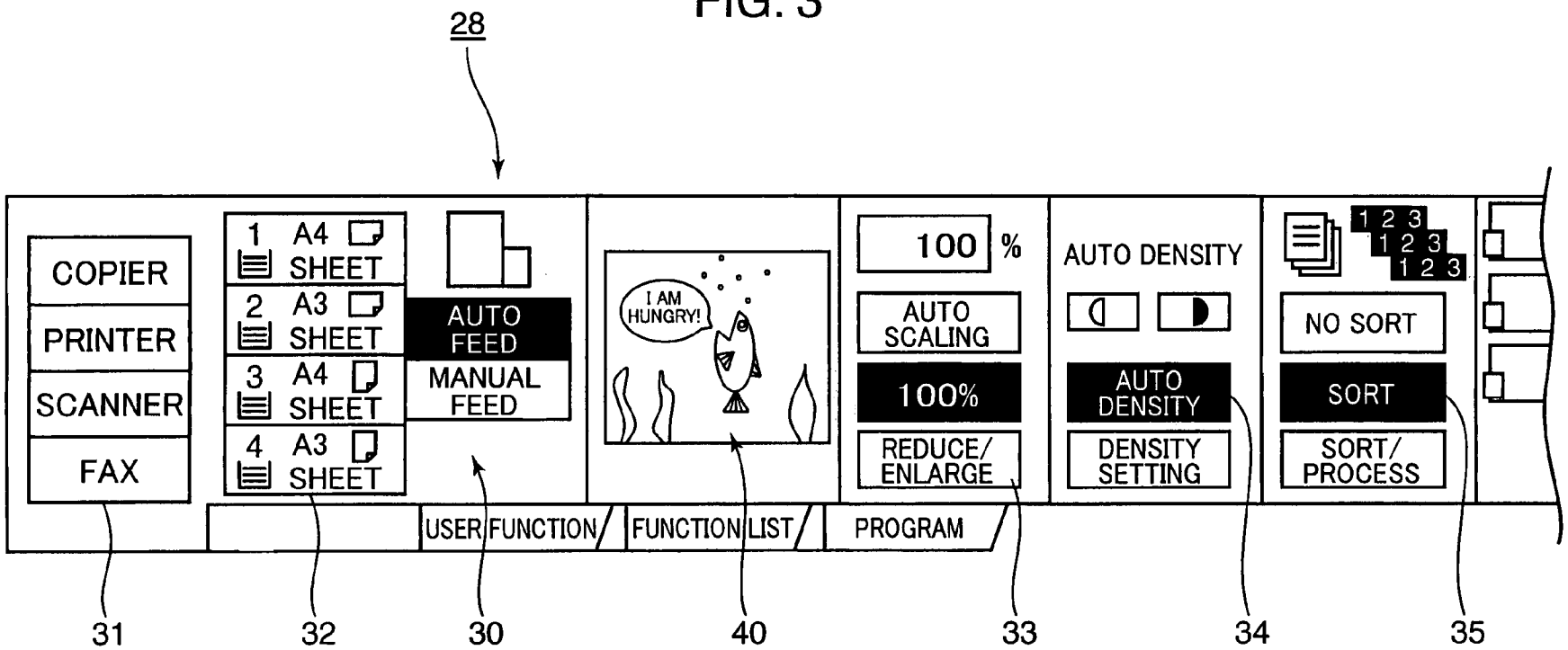
FIG. 3 is a plan view of an operation section of the image forming apparatus.

An operation section 28 is substantially horizontally provided on a front upper side of the image forming apparatus main body 2, as shown in FIG. 3. In more detail, the operation section 28 comprises a function selection key 31 provided at a left end of the drawing which functions as a key operation section, a numeric key pad 36 provided at a right end of the drawing (refer to FIG. 1), and an operation display panel 30 provided at a central position in a horizontal direction of the drawing, including a touch-panel on an upper surface of the liquid crystal display. Furthermore, a status display panel 40 for displaying an image representing a growth stage and/or an appearance of an actual living thing or an imaginary living thing is provided substantially at a center in a horizontal direction of the operation display panel 30.

The operation display panel 30 displays characters and symbols representing various conditions of the image forming operation. The operation display panel 30 also allows an operator to select conditions for the operation by pressing the touch-keys displayed on the touch panel and an image forming operation is carried out in accordance with the selected conditions. Specifically, the operation display panel 30 comprises a sheet feed cassette setting display key 32, an image reduction/enlargement ratio display key 33, an image density setting display key 34, a sorting mode setting display key 35, etc.

In this embodiment, the status display panel 40 displays the current status of the image forming apparatus main body 2. The current status may include a setup status right after the apparatus power is turned on, a normal status showing a stable period after setup, an energy-saving status for suppressing power consumption showing that an image forming operation is suspended, a toner-empty status showing that there is no more toner left and needs to be refilled, a jam status showing that a sheet P has jammed during the convey operation, a remaining sheet status showing the number of remaining sheets after supplementing the sheet feed tray 14 with sheets P to full capacity, the quantity of remaining sheets being determined by relating the total number of sheets in the sheet feed tray 14 to the number of total discharged sheets, a repair-need status (serviceman call status) caused by failures in the apparatus main body, a maintenance-need status showing that a regular checkout of the apparatus main body is required, a cleaning-need status of the photosensitive drum showing that the image formed on the sheet P is deteriorated, etc.

The current status which is displayed on the status display panel 40 may also include the lifespan status of the image forming apparatus main body 2 and the component parts thereof. Here, the life of mechanical parts such as transfer rollers, fixing rollers or cleaning blade and life span of the image forming apparatus main body 2 itself can be considered as lifespan status. In the case that the apparatus main body has a battery incorporated therein, the battery life (battery power) may also be displayed as current status.

In this embodiment, description is given of a case that a status display panel 40 is provided substantially at a central position of the operation section 28. However, if priority is given to operations carried out by using the function selection key 31 and/or the operation display panel 30, the status display panel 40 may be provided at the left or right end portion of the operation section 28.

In this embodiment, the status display panel 40 of the operation section 28 displays an image of a current status of the image forming apparatus main body 2 by relating such status to a growth stage and/or an appearance of an actual living thing such as an animal, fish, human being or plant, etc. The operator can thereby see the image at a first glance. Specifically, the current status of the image forming apparatus main body 2 is not displayed by complex operation indicators such as letters, symbols or images as in conventional apparatuses, but by images showing a growth stage and/or an appearance of friendly living things such as animals, fish, human beings, plants, etc. (actual living things). The operator can thereby quickly and easily know the current status of the image forming apparatus main body 2.

For instance, if the living thing in an image to be displayed on the display screen of the status display panel 40 is a human being, the associated growth stages include baby→kindergartner→elementary school pupil→junior high school student→high school student→college student→working adult→senior person. Accordingly, at the time of setup right after turning on the apparatus, the apparatus is set to display an image of a baby, then, after entering a stable period, an image of an adult, etc. The current status of the apparatus can be displayed by images which are changed in a chronological order. If the printed image becomes dirty, the apparatus is configured to show an image of the human being having dirty clothes. Such an image indicates that the photosensitive drum (not shown) of the image forming portion 7 is deteriorated.

Figure 4B:
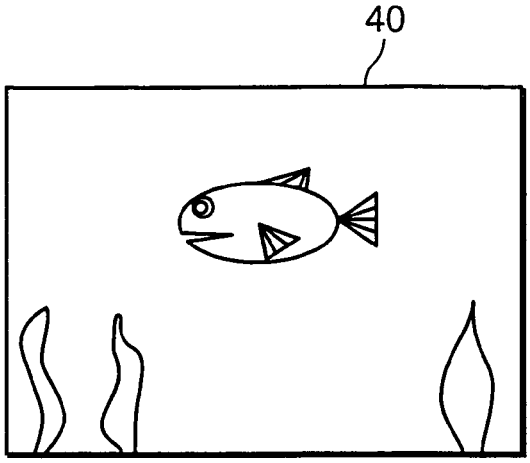
FIGS. 4A to 4D are diagrams showing exemplary status displays using images of a living thing, specifically showing growth stages of a fish displayed on a status display panel.
Figure 4A:
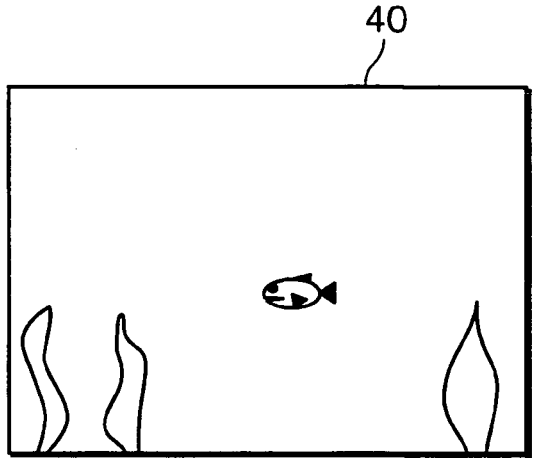
Figure 4D:
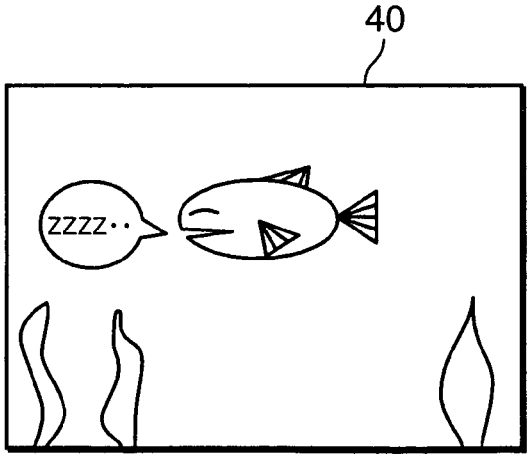
Figure 4C:
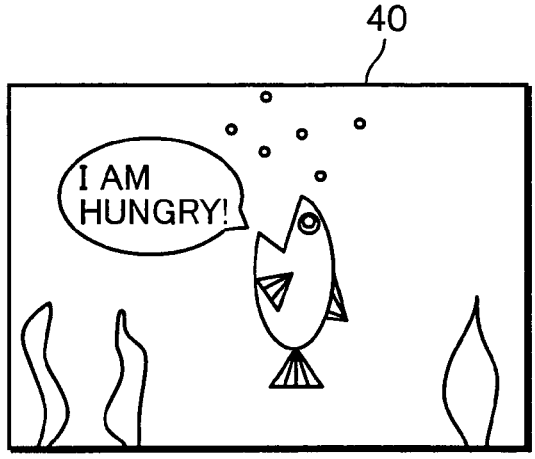

Also, if a living thing in an image to be displayed on the screen is a fish as shown in FIG. 4A, the apparatus is configured to display an image of a baby fish at the time of setup right after the apparatus is turned on, and an adult fish when the apparatus is in a stable normal state after passage of a predetermined time from setup, as shown in FIG. 4B. Also, an image of a hungry fish indicates the status of the remaining toner, particularly a situation when the toner is empty (as shown in FIG. 4C). Also, if the image forming operation is suspended for a predetermined period of time, the apparatus enters an energy-saving mode for suppressing power consumption, and this situation can be shown by an image of a fish that sleeps (refer to FIG. 4D).

Figure 5A:
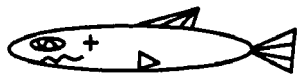
FIGS. 5A and 5B are diagrams illustrating an example of a jam notification display and an example of a service call notification, respectively.
Figure 5B:
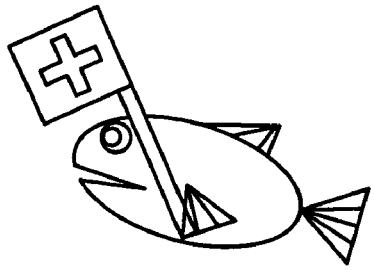

Moreover, as shown in FIGS. 5A and B, in the case that a sheet P jams during convey inside the image forming apparatus main body 2, the displayed image shows an injured fish putting out a flag with a red-cross mark thereon and requesting immediate medical attention, to thereby inform the operator of a serviceman call status (out of order).

Figure 6:
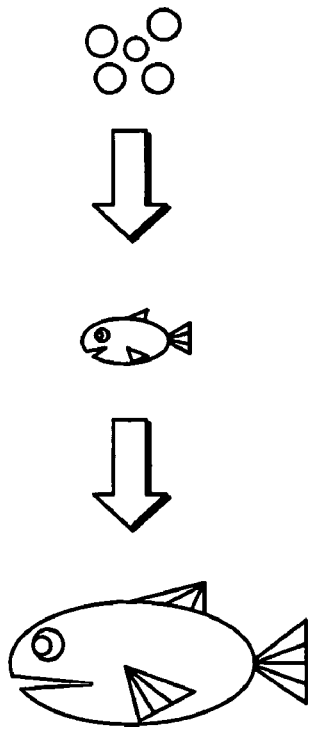
FIG. 6 is a diagram showing a growing process of fish from an egg stage to an adult fish stage.

For instance, if a living thing in an image to be displayed on the status display panel 40 is a fish, growth stages of the fish indicate a variety of statuses as shown in FIG. 6, starting from the fish egg stage, then passing on to the young fish stage and continuing to the adult fish stage.

Specifically, it is possible to display the present status of the number of cumulated discharged sheets by relating it to a predetermined number of discharged sheets. In this case, a growth process of a living thing such as a fish is associated with the number of cumulated discharged sheets such that the growth process of the fish advances with an increase in the number of discharged sheets. Eventually, an image of a fish matured to an elderly fish indicates that the number of cumulated discharged sheets has reached a predetermined number of discharged sheets and accordingly, the apparatus needs maintenance. After the maintenance is completed, the image of the fish is set to a baby fish.

Also, the current status of the number of remaining sheets inside the sheet feed tray 14 (number of remaining sheets in the sheet feed cassettes) can also be displayed. In this case, the image of the fish is associated to the remaining number of sheets in the sheet feed tray 14. Accordingly, right after the number of sheets P in the sheet feed tray 14 is newly set (the sheet feed tray 14 is supplemented with sheets to full capacity), because the number of discharged sheets is zero, an image of fish eggs is displayed on the status display panel 40 at this time. Next, when the number of discharged sheets is about 20 to 30% of the total number of sheets stored in the sheet feed tray 14, the image shows a young fish, whereas when the quantity of discharged sheets has reached about 70 to 80% of the total number of stored sheets, the image shows an adult fish. With such kind of displayed images, the operator can immediately visually confirm what quantity of sheets has been discharged or what the quantity of the remaining sheets is.

In the embodiment described above, a fish is used as an example of an actual living thing, but the description is not limited to fish only such that other animals, human beings, plants or combinations of fish, animals, human beings, plants, etc. may also be considered.

At the same time, imaginary living things which do not exist in the real world may also be used. For instance, images of growth stages and an appearance of imaginary androids, animals and plants, the so-called aliens and man of the future, unique robots or animated characters may also be displayed on the status display panel and may be associated with the current status of the image forming apparatus main body 2.

Figure 7:
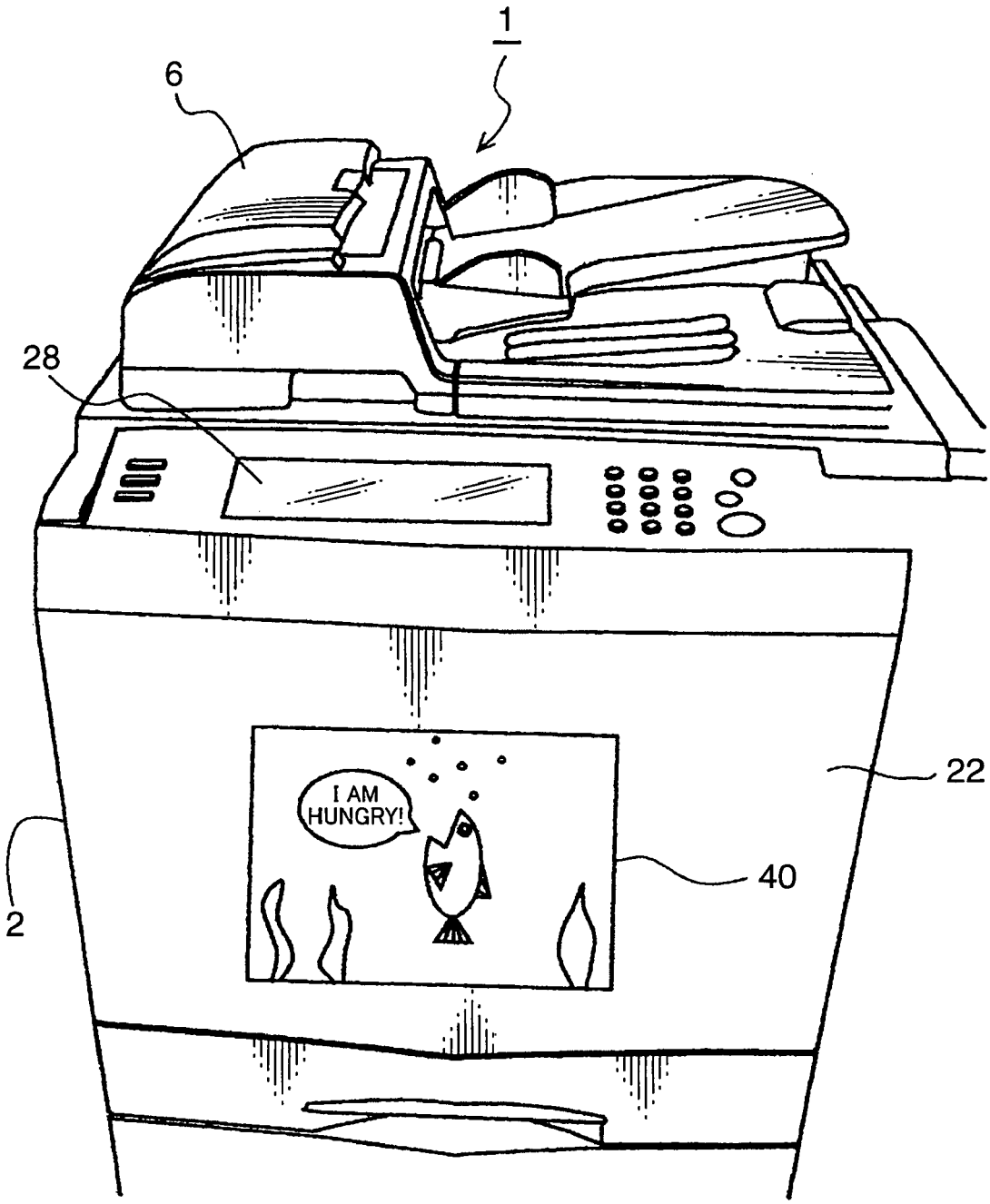
FIG. 7 is a perspective view illustrating an image forming apparatus having a status display panel provided in a front cover thereof, according to a second embodiment of the invention.

FIG. 7 shows another embodiment of an image forming apparatus main body 2 wherein a status display panel 40 is provided on an exterior cover of the apparatus main body 2, more precisely on a front cover 22.

The status display panel 40 of the first embodiment is provided on an upper front side of the image forming apparatus main body 2 in a substantially horizontal position which makes it impossible for the operator to see the displayed contents without getting close to the apparatus main body 2. Consequently, in the second embodiment, the status display panel 40 is provided on the front cover 22 in a substantially vertical position such that even an operator found at a certain distance from the apparatus main body 2 can easily see the displayed contents.

According to this embodiment, the status display panel 40 which is provided on the front cover 22 enables an operator or an persons far away from the image forming apparatus main body 2 to easily know the current status of the image forming apparatus main body 2.

In this embodiment, a description is given only of a case that the status display panel 40 is provided on a front cover 22, however, it may also be provided on an exterior side cover or both on the front cover 22 and the side cover of the image forming apparatus main body 2.

Figure 8:
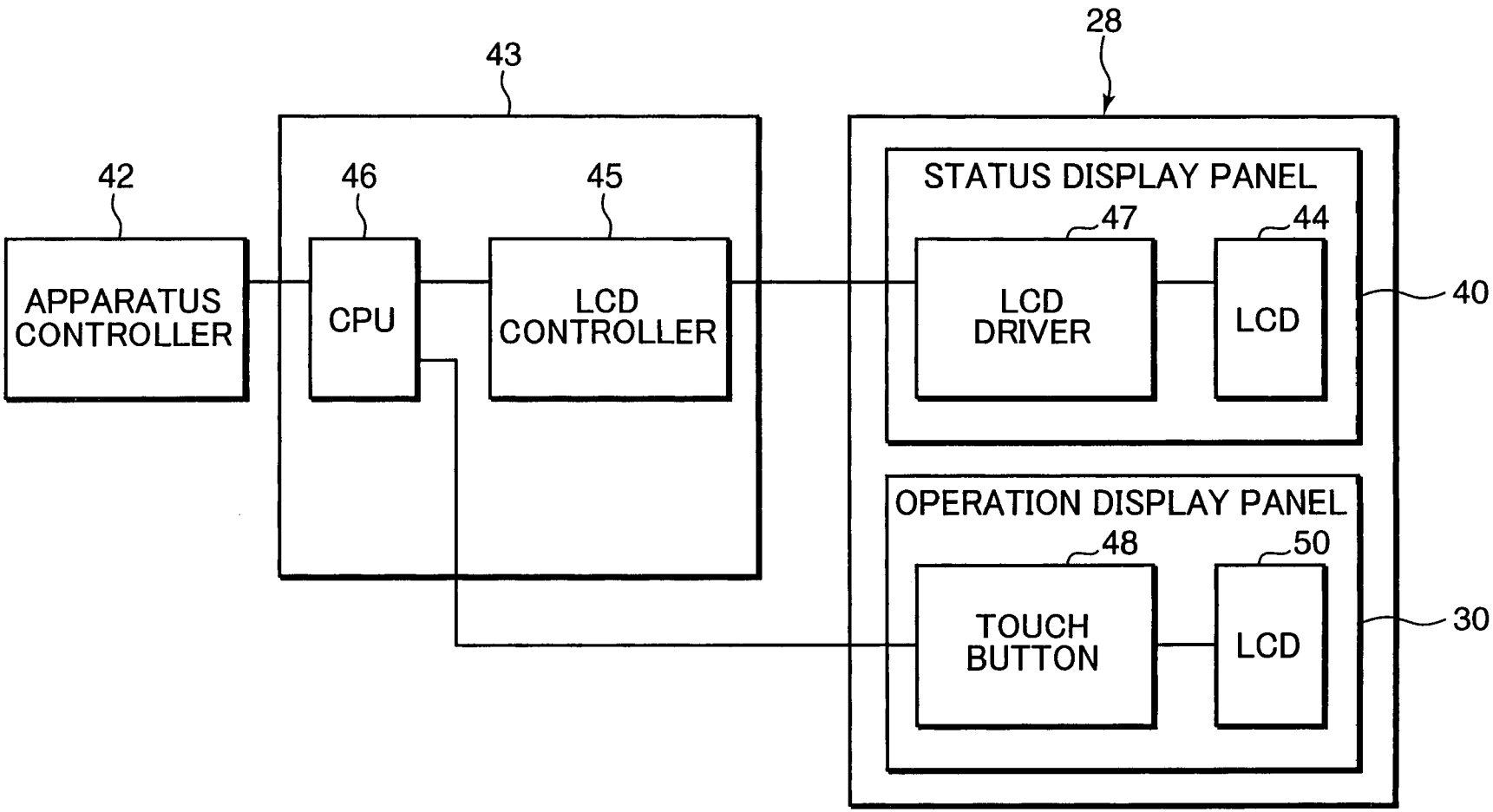
FIG. 8 is a block diagram showing a construction of a printer.

FIG. 8 illustrates control block diagrams of the operation section 28. The display system shown in this drawing includes an apparatus controller 42, a status display control section 43 (display controller) and an operation section 28 controlled by the status display control section 43.

The apparatus controller 42 controls each operation of the image forming apparatus main body 2 in accordance with an input from the operator carried out by pressing a touch button 48 of the operation display panel 30 and based on a predetermined program stored in advance.

The status display control section 43 controls the display of the image to be displayed on the status display panel 40 and includes a liquid crystal display (LCD) controller 45 and a central processing unit (CPU) 46. The CPU 46 receives information regarding the current status of each section (apparatus controller 42) of the image forming apparatus main body 2 and sends a display control instruction signal to the LCD controller 45 in accordance with the received information. The LCD controller 45 generates an image signal for displaying an image of a predetermined character associated with the current status information on a status display panel 40, in accordance with the display control instruction signal received from the CPU 46.

Specifically, after the CPU 46 determines the current status of the image forming apparatus main body 2 in accordance with the control signal sent from the apparatus controller 42, it associates the current status of the apparatus at this time with a growth stage and/or an appearance of an actual living thing or imaginary living thing. At the same time, the LCD controller 45 generates a predetermined image signal corresponding to the current status of the image forming apparatus main body 2. Next, this image signal is outputted from the LCD controller 45 to the LCD driver 47 of the status display panel 40 which drives the LCD 44 comprised of a plurality of picture elements arranged in a matrix.

Accordingly, the current status of the image forming apparatus main body 2 is displayed on the status display panel 40 by it with a growth stage and/or an appearance of an actual living thing such as an animal, fish, human being, plant, etc. Also, with respect to the operation display panel 30, when the operator presses the touch button 48, the LCD 50 is driven to thereby display letters and symbols indicating various functions of the image forming operation.

Figure 9:
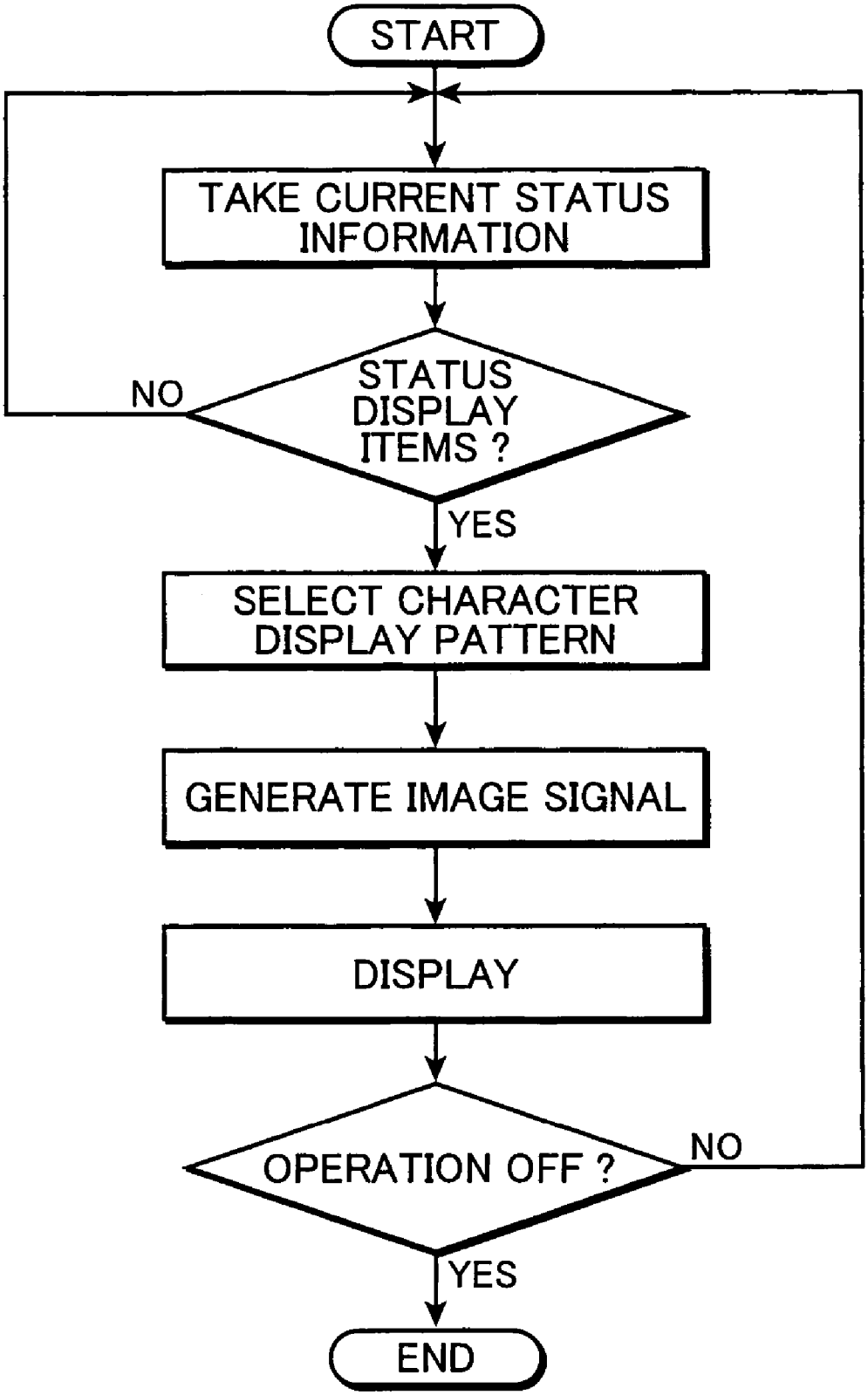
FIG. 9 is a flow chart showing an operation sequence of a display control section.
Figure 10:
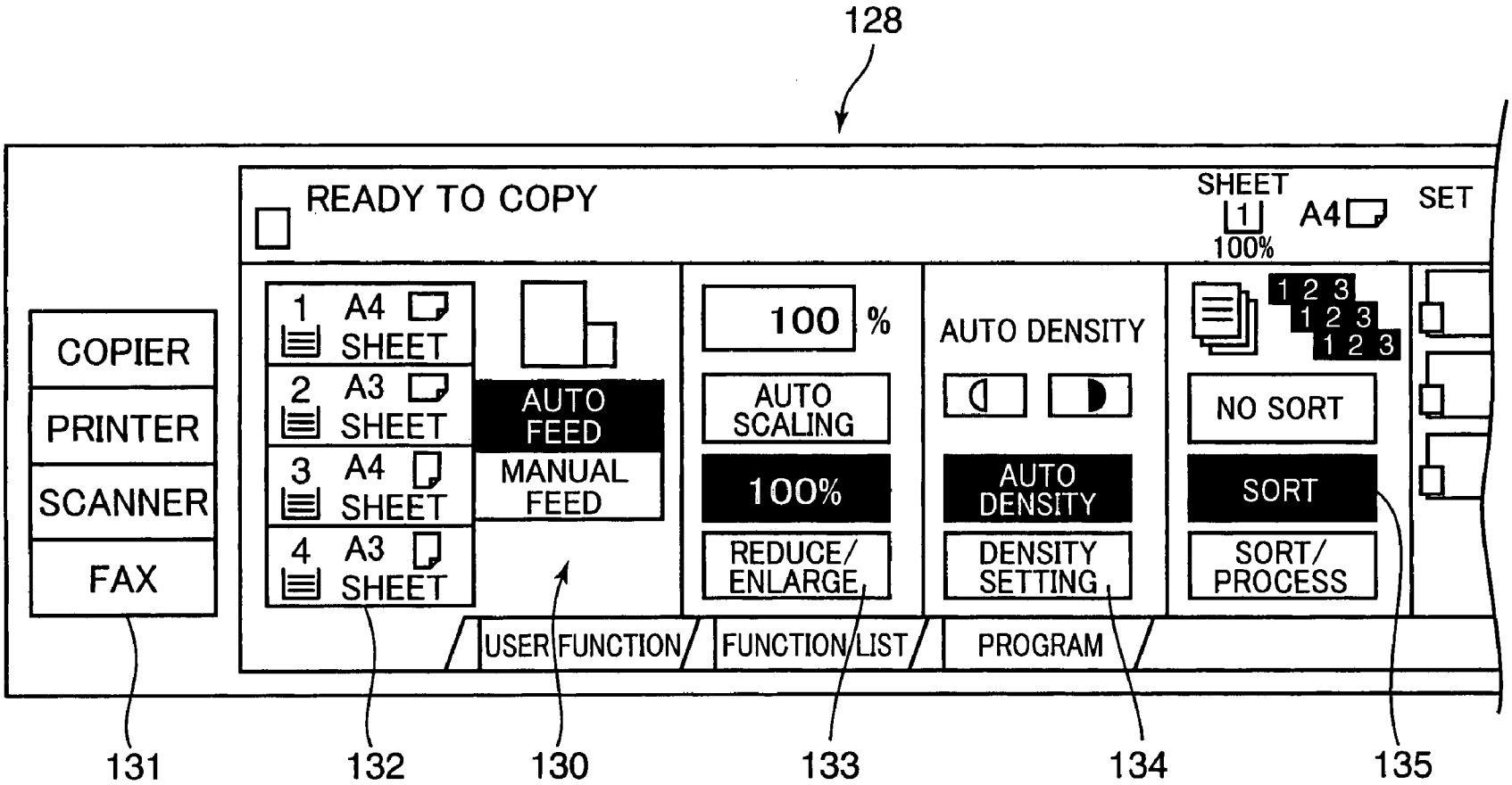
FIG. 10 is a plan view of an operation section of a conventional image forming apparatus.

A description is given next of an operation of the status display control section 43 having the configuration described above, while referring to the flow chart shown in FIG. 9. First, the CPU 46 reads the current status information of the image forming apparatus main body 2 (Step S1). For instance, if a sensor (not illustrated) provided in the apparatus controller 42 detects a toner-empty status, a detection signal is outputted from the apparatus controller 42 to the CPU 46. The CPU 46 handles the received detection signal as information showing the current status of the image forming apparatus main body 2.

Next, the CPU 46 confirms whether the received current status information is the object for display on the status display panel 40 (Step S2). Here, the CPU 46 compares the status display items stored in advance and the received current status information, after which a flag is executed for determining whether a current status information corresponding to one of the status display items has been received or not. If the received current status information does not correspond to any of the status display items (NO in Step S2), the flow returns to Step S1 and the operation is repeated.

If the received current status information corresponds to one of the status display items (YES in Step S2), a character display pattern corresponding to the received current status information is selected (Step S3). For instance, in the case that images similar to the examples illustrated in FIGS. 4A to D are displayed, a display pattern of a fish character for showing the remaining toner quantity is read from the character display patterns stored in advance in the RAM (Random Access Memory) of the image forming apparatus main body 2.

Next, the LCD controller 45 generates an image signal according to the received current status information (Step S4). For instance, an image signal of a hungry fish as illustrated in FIG. 4C is generated. The image signal is outputted to the LCD driver 47 which drives the LCD 44 to display an image on the status display panel 40 in accordance with the image signal (Step S5). Next, the CPU 46 determines whether the image forming apparatus main body 2 is in an operation OFF status (or sleep mode), and in the case that the operation ON status is maintained (NO in Step S6), the flow returns to Step S1 and the operation is repeated.

In the above description, the status display panel 40 is separately positioned adjacent the operation display panel 30. However, other configurations may be considered, for instance, providing a single common display panel (a display panel comprising a status display panel 40 embedded in the operation display panel 30) as an operation display panel 30 and a status display panel 40. In this case, a selection button (not illustrated) is provided to enable the operator to select, with respect to the common display panel, between a normal display for displaying images indicating a variety of functions with respect to the image forming operation (corresponding to the operation display panel 30) and a status display for displaying the images indicating the current status of the image forming apparatus main body 2, the images representing growth stages and/or an appearance of an actual living thing.

Similarly, the single common display panel may be provided that serves as an operation display panel 30 and a status display panel 40. Specifically, when the apparatus is turned on, the common display panel functions as a status display panel 40 that automatically displays an image of a growth stage of an actual living thing or an imaginary living thing representing the current status of the image forming apparatus main body 2 (equivalent to the status display panel 40), and then is switched to a normal display that displays the function selection screen (equivalent to the operation display panel 30) when the operator touches the touch button 48 provided in the operation display panel 30.

In the present embodiments, it is described that an image showing a status of the image forming apparatus main body 2 is displayed by association with a growth stage or an appearance of an animal, however, other embodiments may be considered wherein the current status of the image forming apparatus main body 2 is displayed by combining a corresponding image and a voice announcing the current status.

Also, in the described embodiments, the status display panel 40 is configured to display an image(s) associated with a growth stage and/or an appearance of living things for showing the status of the image forming apparatus main body 2, but it can also be configured to display promotional images and/or messages from the maker on one portion or the entire surface thereof.

The present invention is not limited to the electrical apparatuses and the image forming apparatuses, but may provide an operation program product for executing the operations of these apparatuses. The program product is recorded on computer readable recording media such as flexible disks, CD-ROM, ROM, RAM and memory cards, etc. attached to the computer. The program products may also be provided by recording the programs on recording media mounted in the electrical apparatuses or/and image forming apparatuses, or by downloading them via a network.

This application is based on Japanese Patent Application No. 2004-231946 filed on Aug. 9, 2004, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An electrical apparatus comprising:

an apparatus controller for controlling an operation of the apparatus;

a status display panel provided at a viewable position of a main body of the apparatus, and adapted for displaying an image, and a display controller for controlling the status display panel to display an image including a picture of a predetermined character associated with a current status of the main body, wherein an image relating to the current status of the apparatus is obtained from the apparatus controller to display image information of a character associated with the information of the current status of the main body on the status display panel.

2. The electrical apparatus according to claim 1, wherein the display controller receives information concerning a current status of the main body, and causes the status display panel to display an image including a picture of a predetermined character associated with the received current status information.

3. The electrical apparatus according to claim 2, wherein the display controller is operative for comparing the information concerning a current status of the main body to status display items stored in advance, determining whether the information concerning the current status of the main body corresponds to any of the status display items stored in advance and causing the status display panel to display at least one of the status display items stored in advance that corresponds to the information concerning the current status of the main body.

4. The electrical apparatus according to claim 1, wherein the character is an actual living thing or an imaginary living thing, and the image represents a growth stage and/or an appearance of the actual living thing or the imaginary living thing associated with the current status information of the main body.

5. The electrical apparatus according to claim 4, wherein the actual living thing is an animal, a fish, a human being, a plant or a combination of them.

6. The electrical apparatus according to claim 1, further comprising an operation section, wherein the operation section is provided with an operation display panel adapted for displaying letters, symbols, operation characters representing various functions with respect to the operation of the apparatus to allow an operator to select a desired function, and the status display panel is incorporated in the operation display panel.

7. The electrical apparatus according to claim 1, further comprising an exterior cover covering an inside of the electrical apparatus, wherein the status display panel is provided in the exterior cover.

8. The electrical apparatus according to claim 7, wherein the electrical apparatus is an image forming apparatus.

9. The electrical apparatus according to claim 8, wherein the image forming apparatus has at least one of a scanning section for scanning an image on a document and a printing section for printing an image on a sheet, and wherein the display controller is operative for displaying an image on the display panel independent of any image scanned by the scanning section or printed by the printing section.

10. An image forming apparatus comprising:

an apparatus controller for controlling an operation of the image forming apparatus;

an operation display panel provided in an operation section of a main body of the image forming apparatus, and adapted for displaying letters, symbols, operation characters representing various functions with respect to an image forming operation to allow the operator to select a desired function; and a status display panel provided in the operation section or the operation display panel for displaying an image representing a growth stage and/or an appearance of a character of an actual living thing or an imaginary living thing to show a current status of the main body, wherein an image relating to the current status of the image forming apparatus is obtained from the apparatus controller to display image information representing a growth stage and/or an appearance of a character associated with the information of the current status of the main body on the status display panel.

11. The image forming apparatus according to claim 10, further comprising a display controller adapted for controlling the display of the image on the status display panel, wherein the display controller receives status information about a current status of the main body, and causes the status display panel to display an image representing a growth stage and/or an appearance of the actual living or imaginary living thing in association with the received current status information.

12. The image forming apparatus according to claim 11, wherein the image forming apparatus has at least one of a scanning section for scanning an image on a document and a printing section for printing an image on a sheet, and wherein the display controller is operative for displaying an image on the display panel independent of any image scanned by the scanning section or printed by the printing section.

13. The image forming apparatus according to claim 11, wherein the display controller is operative for comparing the information concerning a current status of the main body to status display items stored in advance, determining whether the information concerning the current status of the main body corresponds to any of the status display items stored in advance and causing the status display panel to display at least one of the status display items stored in advance that corresponds to the information concerning the current status of the main body.

14. The image forming apparatus according to claim 10, wherein the current status of the apparatus main body includes at least one or more current statuses selected from the group consisting of a setup status right after the apparatus power is turned on, a toner-empty status that no toner is remained, a sheet jam status that a sheet is jammed in the course of conveying the sheet, an image deterioration status that an image recorded on the sheet is deteriorated, an energy-saving status that the image forming operation is suspended for a predetermined time, a maintenance need status that a regular maintenance operation of the apparatus main body is needed, a remaining sheet status, a lifespan status of the apparatus main body and component parts thereof.

15. An image forming apparatus comprising:

an apparatus controller for controlling an operation of the image forming apparatus;

an operation display panel provided in an operation section of a main body of the image forming apparatus, and adapted for displaying letters, symbols, operation characters representing various functions with respect to an image forming operation to allow the operator to select a desired function, wherein the operation section comprises a selection switch for performing selection of a usual display in connection with various functions with respect to the image forming operation and a status display for displaying an image representing a growth stage and/or an appearance of a character of an actual living thing or an imaginary living thing to show a current status of the image forming apparatus main body, wherein an image relating to the current status of the image forming apparatus is obtained from the apparatus controller to display image information representing a growth stage and/or an appearance of a character associated with the information of the current status of the main body on the status display.

16. The image forming apparatus according to claim 15, wherein the images displayed by the status display to show a current status of the image forming apparatus main body are different from the usual display showing various functions with respect to the image forming operation.

17. The image forming apparatus according to claim 15, wherein the operation section is operative for comparing a current status of the image forming apparatus main body to status display items stored in advance, determining whether the information concerning the current status of the main body corresponds to any of the status display items stored in advance and causing the status display to display at least one of the status display items stored in advance that corresponds to the current status of the image forming apparatus main body.

18. A program product for operating an image forming apparatus, the image forming apparatus comprising an apparatus controller for controlling an operation of the image forming apparatus, a status display panel provided at a viewable position of a main body of the image forming apparatus and capable of displaying an image, and a display controller adapted for controlling the display of the image displayed on the status display panel, the program product causing the display controller to execute:

a step of receiving status information about a current status of the main body from the apparatus controller;

a step of generating an image signal including picture information of a predetermined character associated with the received current status information of the main body; and a step of displaying an image on the status display panel in accordance with the generated image signal.

19. The program product according to claim 18, wherein the program product causes the display controller to execute a step of generating an image signal that is different from an image formed by operation of the image forming apparatus.

20. The program product according to claim 18, wherein the program product further causes the display controller to execute a step of comparing the information about a current status of the main body to display items stored in advance, the step of generating the image signal includes generating an image signal for at least one of the status display items stored in advance corresponding to the received information about a current status of the main body.

* * * * *